United States Patent [19]

Eheim et al.

[11] 4,385,614

[45] May 31, 1983

[54] FUEL INJECTION PUMP FOR INTERNAL COMBUSTION ENGINES

[75] Inventors: Franz Eheim; Wolfgang Geiger, both of Stuttgart; Werner Stadler, Kornwestheim, all of Fed. Rep. of Germany

[73] Assignee: Robert Bosch GmbH, Stuttgart, Fed. Rep. of Germany

[21] Appl. No.: 137,033

[22] Filed: Apr. 3, 1980

[30] Foreign Application Priority Data

Apr. 6, 1979 [DE] Fed. Rep. of Germany ..... 2913909
Mar. 3, 1980 [DE] Fed. Rep. of Germany ..... 3008070

[51] Int. Cl.[3] ..... F02M 59/02; F04B 39/10

[52] U.S. Cl. ..... 123/506; 417/499; 417/279

[58] Field of Search ..... 123/506, 503, 497, 499; 417/499, 279, 500

[56] References Cited

U.S. PATENT DOCUMENTS

| | | | |
|---|---|---|---|
| 3,661,130 | 5/1972 | Eheim | 123/506 |
| 3,724,436 | 4/1973 | Nagata | 123/506 |
| 3,930,480 | 1/1976 | Yamada | 417/499 |
| 3,981,634 | 9/1976 | Staudt | 417/499 |
| 4,062,336 | 12/1977 | Gant | 123/506 |
| 4,093,713 | 8/1977 | Eheim | 417/499 |
| 4,273,091 | 5/1981 | Stumpp | 123/506 |

*Primary Examiner*—Charles J. Myhre
*Assistant Examiner*—Carl Stuart Miller
*Attorney, Agent, or Firm*—Edwin E. Greigg

[57] ABSTRACT

A fuel injection pump for internal combustion engines is proposed, the work chamber of which has a relief channel which is controllable via an electromagnetically actuatable valve, the movable valve element of which is urged in a closing direction by means of the pressure which prevails in the pump work chamber.

14 Claims, 6 Drawing Figures

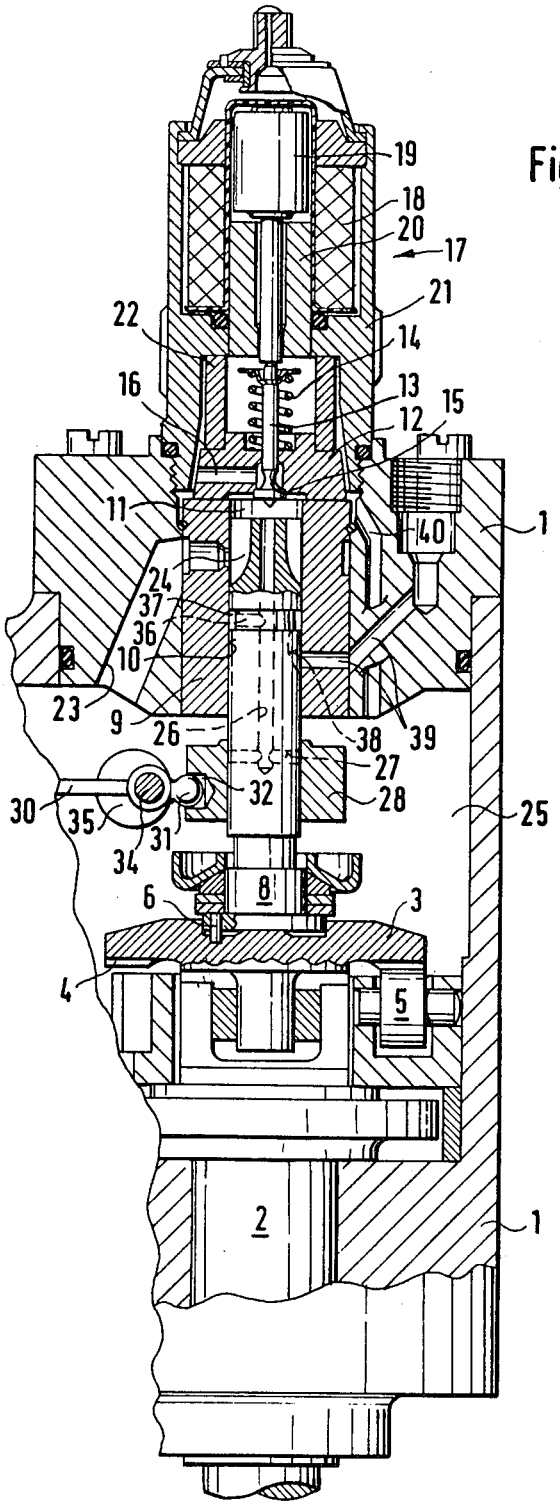
Fig. 1
Fig. 2
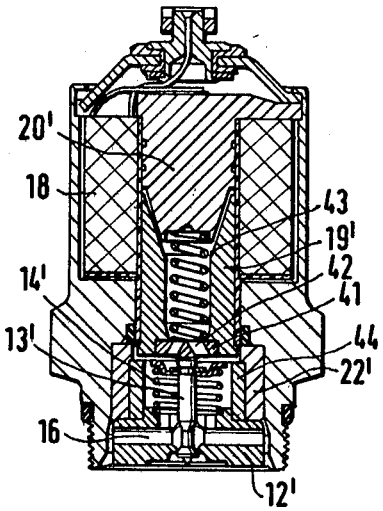

FUEL INJECTION PUMP FOR INTERNAL COMBUSTION ENGINES

BACKGROUND OF THE INVENTION

The invention relates to a fuel injection pump for internal combustion engines of the type described in the preamble to the main claim. In a known fuel injection pump of this kind, the relief channel which determines the end of injection is controlled via distributor grooves and additionally by a magnetic valve. As a result, it is not possible to shut off the engine by shutting off the fuel injection quantity. In another known fuel injection pump, a magnetic valve is disposed in the channel which leads from the suction chamber of the pump to the pump working chamber, and by means of this valve the fuel supply of the pump working chamber can be interrupted in order to shut off the internal combustion engine. In both known cases, the distributor grooves substantially act as a pressure barrier between the pump working chamber and the valve, so that the closing springs of the valve or the strength of the magnet does not need to be adapted to the pump working pressure.

OBJECT AND SUMMARY OF THE INVENTION

The fuel injection pump according to the invention and having the characteristics of the main claim, in contrast, enables an opening of the relief channel before the beginning of the compression stroke, if this opening is required, and enables absolute tightness during the compression stroke so long as the valve is closed.

The valve in accordance with the invention can be opened via the magnet either without electrical current or under the effect of electrical potential, where in the one case an opening force of a spring is overcome by the magnet causes the opening and in the other case it is the magnet itself which effects this opening. The use of a magnet-controlled valve can either serve to shut off the internal combustion engine or may act as a quiet-idling device, wherein a portion of the fuel flows out of the pump working chamber and as a result the injection time is lengthened, because a smaller quantity of fuel per unit of time proceeds to injection.

The invention is not limited to the embodiment of the valve, but rather also pertains to the combination with characteristics of the structure and/or the purpose of its use.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 shows a partial cross-sectional view of an adjusting device in a fuel pump, with the magnet switched on;

FIG. 2 is a detailed view in cross section of the magnet area only which is then free of electrical current;

DESCRIPTION OF THE PREFERRED EMBODIMENTS

Figure 4:
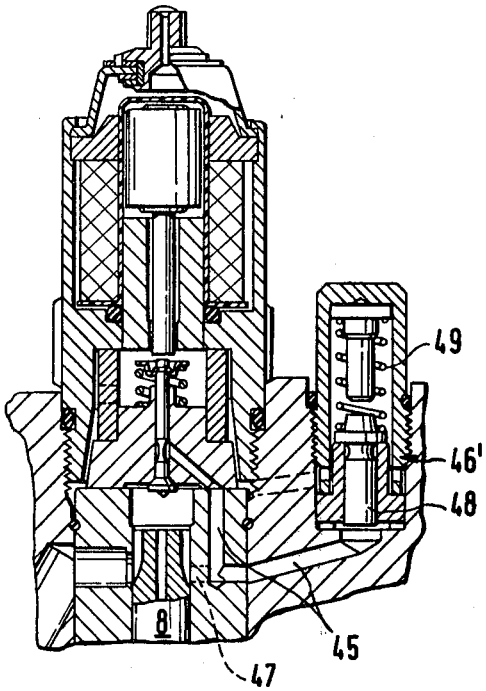
FIG. 4 shows a similar cross-sectional view of the same area using a spring reservoir.

Turning now to the drawings, a drive shaft 2 is supported in a housing 1 of a fuel injection pump for internal combustion engines with multiple cylinders. The drive shaft 2 is drivably associated with the end face of the cam disc 3, which is appropriately provided with four cams for example of a four cylinder engine to be supplied with fuel. The cams are moved over stationary rollers 5 as a result of the rotation of the drive shaft 2. Consequently, a pump piston 8 coupled with the end face cam disc 3 by means of a coupler element 6 and pressed thereon by means of at least one spring is simultaneously set into reciprocal and rotary motion.

The pump piston 8 operates in a cylindrical bushing 9 having a cylindrical bore 10 which is inserted into the housing 1 and closed at the top and a work chamber 11 is enclosed in the cylindrical bushing 9 by means of a pump piston 8. A valve body 12 serves to close the cylindrical bushing 9 and with a movable valve element 13 represents a relief valve for the pump work chamber. The movable valve element 13 is under the influence of a closing spring 14, which presses a head 15 of the movable valve element 13 onto a seat in the valve body 12. The head 15 is additionally pressed onto its seat by the pressure prevailing in the pump work chamber 11. A relief channel 16 is controlled by this valve and leads to a chamber in which a pressure prevails which is lower than the pressure prevailing in the pump work chamber 11 during the compression stroke.

The movable valve element 13 is actuated by means of an electromagnet 17, which has a coil 18 and an armature 19 as well as a core 20. The housing 21 of the magnet 17 is threaded into the housing 1 of the fuel injection pump, as shown, and via an expansible casing 22 holds the valve body 12 firmly on the cylindrical bushing 9, so that certain variable expansions of the valve body, magnet housing and pump housing which occur when the temperature changes can be compensated for. In other words, as seen in the Figures, casing 22 is prestressed along its longitudinal axis between the housing 21 and valve 12. Due to this tight fit, which firmly holds the valve 12 on bushing 9, the casing is elastically deformed. If there are any occurrences of varying heat expansions, then the deformed portion of the casing 22 is capable of compensating for nonuniform variations in length, and it thus assures fundamental tightness of sealing under all operating conditions of the fuel injection pump. The casing thus has a function similar to that of an "anti-fatigue bolt."

The pump work chamber 11 is supplied with fuel via a suction channel 23, which is controlled via suction grooves 24 disposed on the jacket surface of the piston 8. These suction grooves 24 open the suction channel 23 upon the occurrence of the suction stroke of the pump piston 8. The fuel supply is affected out of a suction chamber 25, which is disposed in the housing 1 and in which a slight overpressure prevails. For the purpose of controlling the supplied fuel quantity, the work chamber 11 can be connected via an axial blind bore 26 in the pump piston 8 and a transverse bore 27 which intersects the blind bore with the pump suction chamber 25. A fuel supply quantity control member 28 in the form of an annular slide displaceable on the pump piston, cooperates with the transverse bore 27 with the arrangement being such that the position of the annular slide determines the instant at which the transverse bore 27 opens during the upward movement of the pump piston 8 (compression stroke) and at which time a connection is established between the work chamber 11 and the pump suction chamber 25.

By means of the adjustment of the annular slide 28, the quantity of fuel not proceeding to injection can thus be varied. In order to vary the fuel injection quantity, the annular slide 28 is adjusted by means of a control lever 30, which with a ball head 31 engages a recess 32 of the annular slide 28. The control lever 30 is pivotable about a shaft 34, which is adjustable by means of an eccentric 35. The other end of the control lever 30 is engaged by a control spring, not shown, against the force of an rpm transducer. The initial stress of the control spring may be varied, for instance, by means of an adjusting lever which in turn can be adjusted arbitrarily. The rpm transducer then acts in the proper direction to reduce the fuel injection quantity when the rpm level is increasing, while the control spring acts in the direction of an increase in the fuel injection quantity. The rpm transducer may be a centrifugal force transducer or a hydraulic transducer. The particular balanced position which corresponds to a certain fuel injection quantity can be appropriately varied by means of the adjusting lever.

The supply of fuel to the engine from the pump work chamber 11 takes place during the compression stroke and during the period when the transverse bore 27 is closed, fuel being supplied via the blind bore 26 which communicates via a transverse bore 36 with an annular groove 37, from which a distributor groove 38 branches off, by means of which in turn a pressure line 39 is opened. Pressure lines 39 are provided about the distributor piston 8 corresponding to the number of engine cylinders to be supplied; only one of these pressure lines 39 is shown in the drawing. During the rotation of the pump piston 8, the pressure lines 37 are opened by means of the lengthwise groove 38 one after another and are accordingly supplied with fuel from the pump work chamber 11, until the transverse bore 27 is opened by means of the annular slide 28 and the fuel can flow back from the pump work chamber 11, unused, into the suction chamber 25.

In the exemplary embodiment shown in FIGS. 1 and 2, the fuel which flows out of the pump work chamber 11 via the valve 12, 13 flows out of the relief channel 16 into a channel 40, which terminates in the suction chamber 25. Thus, as soon as the valve 12, 13 is opened, the fuel flows unused back out of the pump work chamber 11 and into the suction chamber 25, so that the engine is shut off.

In the first exemplary embodiment shown in FIG. 1, the armature 19, when the magnetic coil 18 of the electromagnet 17 is excited, is pulled downward against the core 20 and is supported on the movable valve element 13. During the compression stroke of the pump piston 8, the magnet 17 cannot overcome the force in the compression chamber 11 which acts in the closing direction of the valve 12, 13. However, as soon as the pump piston 8 begins its suction stroke, the magnet overcomes the force of the closing spring 14 and opens the valve 12, 13. During the subsequent compression stroke of the pump piston 8, no pressure can be established in the pump work chamber 11, so that the valve 12, 13 remains in the open position and all the fuel supplied by the pump piston 8 flows back, unused, into the suction chamber 25 via the channels 16 and 40. Even when because of dynamic throttle relationships between the head 15 and the valve body 12 there are strong forces which act on the movable valve element 13 in the closing direction, which forces overcome the forces of the magnet, still during the next suction stroke the valve is again opened, so that the result is a great reduction in rpm and finally a shut-off of the engine.

Figure 3:
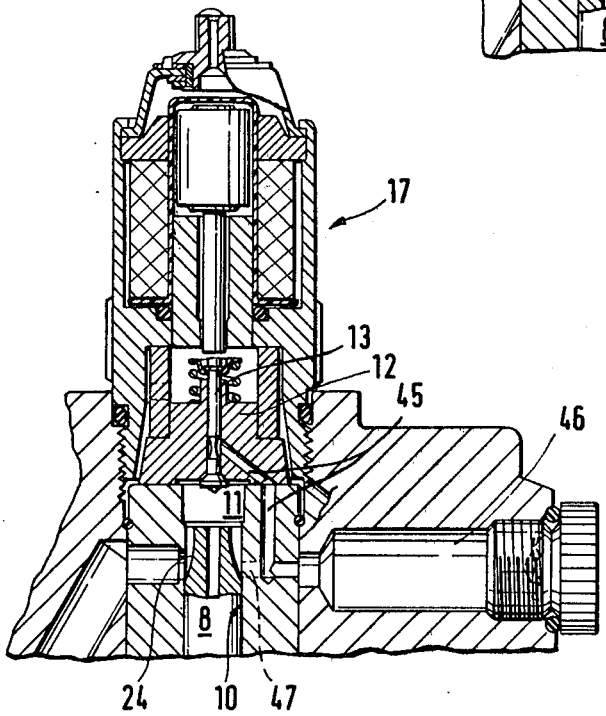
FIG. 3 shows a detailed cross-sectional view of the upper portion of the fuel pump with a quiet-idling apparatus, with fuel diversion into a reservoir.

In a further three exemplary embodiments shown in FIGS. 2–4, corresponding structural elements have the same reference numerals as in the first exemplary embodiment; if there is a structural difference in the embodiment, the reference numeral is provided with a prime.

In the second exemplary embodiment shown in FIG. 2, only the magnet and the valve drive thereby are shown. In contrast to the first exemplary embodiment, the core 20' of the magnet is disposed at the top and the armature 19' at the bottom toward the valve. When the coil 18 is excited the armature 19' is thus pulled upward against the core 20'. The armature 19' has an inner bore which is closed at the bottom by a base 41 in which plural means defining openings 42 are provided for the purpose of pressure equalization. Between this base 41 and the core 20', an opening spring 43 is disposed which when the magnet is not excited displaces the armature 19' against the movable valve element 13', thus overcoming the force of the closing spring 14' and opening the valve 12', 13'. The stroke of the armature 19' is limited by an annular stop 44. There, as well, the opening spring 43 is able to open the valve only when the pump piston 8 completes a suction stroke. As soon as the coil 18 is excited the armature 19' is drawn upward with the force of the spring 43 being overcome, so that the closing spring 14' pulls the movable valve element 13' onto its seat and prevents the outflow of fuel via the channel 16.

The coil 18 is switched on, for instance, via the ignition key of the engine, so that for starting the magnet is excited and thus an outflow of fuel through the relief channel 16 is prevented; thus, the engine can start. The shut-off of the engine then takes place by means of switching off the magnet 17; the ignition key breaks the electrical circuit, and subsequently the valve 12', 13' is opened by means of the spring 43 and the fuel supplied by the piston 8 flows, unused, back into the suction chamber 25, with the result that the engine is shut off.

In the third exemplary embodiment shown in FIG. 3, the valve 12, 13 and the magnet 17 are embodied like those shown in the first exemplary embodiment in FIG. 1. In contrast to this first embodiment, however, the fuel diverted by means of the valve is conveyed through the throttle gap X via a channel 45 into a reservoir 46. The valve 12, 13 is opened only during idling and possibly at low partial-load, so that a portion of the fuel supplied by the pump flows into this reservoir 46, with the result that the injection time then taking place in the engine is lengthened. A lengthening of the duration of injection of this kind brings about a considerable reduction in engine noise; that is, so-called quiet idling of the engine is brought about. During the suction stroke of the pump piston 8, a portion of the fuel located in the reservoir 46 flows back into the pump work chamber 11. This return flow can take place either via the relief channel 45 and the valve 12, 13 or via one of the suction grooves 24; in the latter case, the channel 45 must have an appropriate extension 47 oriented toward the bore 10. The magnet 17 may, for example, be controlled by means of a switch actuated with the accelerator pedal, so that the accelerator pedal position for idling and partial-load bring about a corresponding excitation of the magnet 17.

In the fourth exemplary embodiment, shown in FIG. 4, in contrast to the third embodiment shown in FIG. 3, the reservoir is embodied as a spring reservoir 46'. The spring reservoir 46' functions by means of a reservoir piston 48, which is under the influence of a spring 49. While in the exemplary embodiment of FIG. 3, the reservoir capacity depends substantially on the elasticity of the fuel, in the exemplary embodiment shown in FIG. 4 the reservoir capacity is additionally determined by the stroke of the reservoir piston 48.

Figure 5:
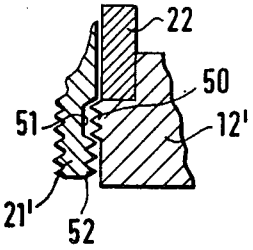
FIG. 5 is a fragmentary sectional view of a means for simplifying assembly of the valve body.

In FIG. 5, a means of simplifying mounting is shown for the valve body 12". The valve body 12" has a threaded area 50 with few threads on its jacket surface; in the illustrated state, which is also the installed state, the threaded area 50 protrudes into an annular groove 51 which is disposed in the inner bore of the magnet housing 21'. A thread 52 is adjacent to this annular groove 51 on the side oriented toward the end of the bore. The valve body 12" is threaded into the magnet housing 21' by means of this thread 52, until the threaded area 50 is so disposed as to fit into the annular groove 51 without threaded engagement. During mounting or unmounting of the magnet, the valve body 12" and the casing 22 both remain together with the magnet housing 21.

Figure 6:
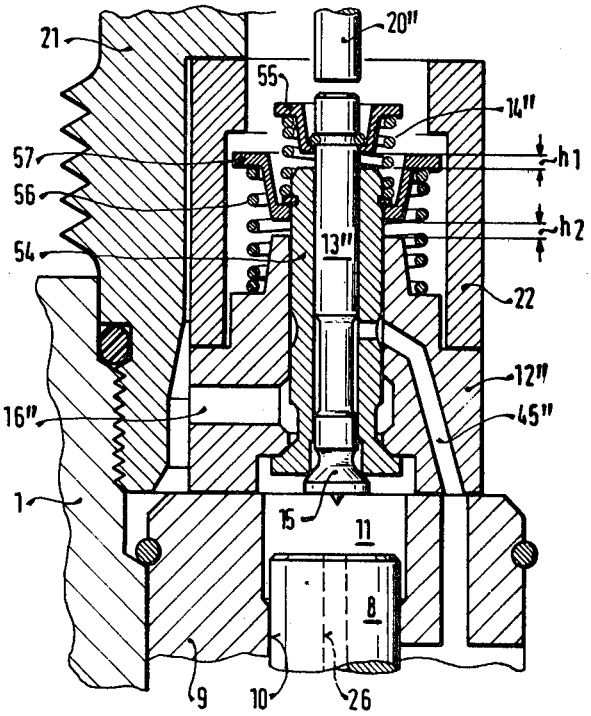
FIG. 6 shows a cross section, on an enlarged scale, a combined device for shutoff and for quiet idling.

In the exemplary embodiment shown in FIG. 6, one controlled valve each is provided for shutoff and for prolonging the injection time. The movable valve element 13" serving to prolong the injection time is disposed in a valve element 54 serving the purpose of shutoff of the engine, and the valve element 54 is disposed in the valve body 12". The fuel quantity diverted for the purpose of quiet idling flows out via a channel 45", while the fuel diverted for the purpose of shutoff flows out via a relief channel 16". The channel 45", as in the exemplary embodiments described above, can discharge either into a reservoir or, throttled, into a chamber of lower pressure. In each case, the quiet-idle channel must always be openable first before a shutoff is undertaken. The magnet, of which only the armature 20" is shown here, is embodied as a two-stage magnet, which in the first stage, $h_1$, opens the quiet-idle channel 45" and then in the second stage, $h_2$, opens the relief channel 16".

The valve element 13" is urged in the closing direction by a spring 14", which is supported on one end on a spring plate 55 connected to the valve element 13" and on the other end on the valve element 54. The valve element 54, in turn, is acted upon by a spring 56, which is supported on the valve body 12" and on a spring plate 57 at its respective ends. During the first stage, $h_1$, of the magnet, only the spring 14" is compressed. Then, for the second stage, $h_2$, the valve element 54 is displaced by the spring plate 55 against its spring 56.

It is also conceivable that the valve members for shutoff and for quiet idling may function disposed beside one another, with the magnet in the first stage engaging only one member, and in the second stage engaging both members.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for an internal combustion engine having a pump housing, an electromagnetic valve with a magnet and a valve seat, a pump work chamber, a relief chamber, a channel which connects said pump work chamber to said relief chamber and which includes a passage connected to and controlled by said electromagnetic valve, wherein said fuel injection pump also includes:

a threaded magnet housing in which said magnet is housed and which is threaded to said pump housing and which has an inner bore with a step, wherein the electromagnetic valve is embodied as a seat valve having a movable valve element which is connected to said pump work chamber to be biased in a closed direction by pressure prevailing in the pump work chamber, and wherein said fuel injection pump also includes:

a valve body positioned to enclose said valve seat and said movable valve element within said pump housing and having a bore which comprises a portion of said channel; and an expansible casing positioned between said valve body and said magnet housing such that said threaded magnet housing surrounds said expansible casing, whereby said casing allows for variable expansions of said valve body, said magnet housing and said pump housing occuring with temperature changes.

2. A fuel injection pump in accordance with claim 1, characterized in that said valve can be opened via a first spring element the force of which is greater than the sum of the force of a second spring element which acts in the opposite direction and the flow force of the fuel which, because of a pressure difference, engages said movable valve element when the valve is opened.

3. A fuel injection pump in accordance with claim 2, characterized in that the force of the electromagnet is greater than the force of said first spring.

4. A fuel injection pump in accordance with claim 1, characterized in that said valve includes a body portion having an exteriorly threaded terminal area, said threaded area arranged to be received in a threaded area in said magnet housing.

5. A fuel injection pump in accordance with claim 4, characterized in that said magnet housing includes an annulus adjacent to said threaded area and the threaded area of said body is received therein so that said body is held in suspension.

6. A fuel injection pump in accordance with claim 1, characterized in that said channel leads to a chamber of lower pressure, e.g., said suction chamber of said injection pump.

7. A fuel injection pump in accordance with claim 1, characterized in that said channel leads into a closed reservoir chamber.

8. A fuel injection pump in accordance with claim 6, characterized in that said reservoir includes a spring urged piston.

9. A fuel injection pump in accordance with claim 6, characterized in that a throttle is disposed in said channel.

10. A fuel injection pump in accordance with claim 1, characterized in that said seat valve is arranged to cooperate with a further valve, one of said valves adapted to control engine shutoff and the other of said valves adapted to control quiet idling, each of said valves further arranged to control separate flow channels.

11. A fuel injection pump in accordance with claim 10, characterized in that both said valves are controllable by means of said magnet.

12. A fuel injection pump in accordance with claim 10, characterized in that said seat valve which serves the purpose of quiet idling is adjustable by said magnet during a first stroke stage ($h_1$) and said other valve which serves the purpose of engine shutoff is adjustable by said magnet during a second stroke stage ($h_2$).

13. A fuel injection pump in accordance with claim 12, characterized in that said movable valves are disposed coaxially inside one another, and that after the first stroke ($h_1$) has been performed by said first valve, said second valve performs the stroke ($h_2$).

14. A fuel injection pump in accordance with claim 11, characterized in that one of said valve members is disposed in the other of said valves.

* * * * *